US006363843B1

(12) United States Patent
Daniel et al.

(10) Patent No.: US 6,363,843 B1
(45) Date of Patent: Apr. 2, 2002

(54) WIRE TIE GUIDE WITH TYING DEVICE AND METHOD

(75) Inventors: Barton W. Daniel, Kennesaw; Thomas S. Simmons, Atlanta, both of GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/389,312

(22) Filed: Sep. 2, 1999

(51) Int. Cl.[7] ..... B65B 13/20; B65B 13/06
(52) U.S. Cl. ..... 100/3; 100/25; 100/34
(58) Field of Search ..... 100/3, 25, 33 R, 100/34; 140/101, 111, 114

(56) References Cited

U.S. PATENT DOCUMENTS

| | | | |
|---|---|---|---|
| 1,409,724 | A | 3/1922 | Jefferson |
| 3,037,535 | A | 6/1962 | Linehan et al. |
| 3,051,076 | A | 8/1962 | West |
| 3,168,912 | A | 2/1965 | Marica |
| 3,475,879 | A | 11/1969 | Merkel et al. |
| 3,477,363 | A | 11/1969 | Trumbo |
| 3,528,364 | A | 9/1970 | Freund |
| 3,677,377 | A | 7/1972 | Miller |
| 3,863,297 | A | 2/1975 | Simich |
| 3,863,558 | A | 2/1975 | Trumbo |
| 3,921,799 | A | 11/1975 | Meier |
| 3,949,450 | A | 4/1976 | Bailey |
| 4,055,115 | A | 10/1977 | Simich et al. |
| 4,055,328 | A | 10/1977 | Simich |
| 4,070,733 | A | 1/1978 | Simich |
| 4,092,912 | A | 6/1978 | Simich |
| 4,147,188 | A | 4/1979 | Simich |
| 4,320,701 | A | 3/1982 | Donaldson |
| 4,342,138 | A | 8/1982 | Simich |
| 4,353,295 | A | 10/1982 | Kandarian |
| 4,375,118 | A | 3/1983 | Saylor |
| 4,403,542 | A | 9/1983 | Lewis |
| 4,438,689 | A | 3/1984 | Simich |
| 4,450,763 | A | 5/1984 | Saylor |
| 4,459,904 | A | 7/1984 | Probst et al. |
| 4,484,518 | A | 11/1984 | Jaenson |
| 4,509,416 | A | 4/1985 | Simich |
| 4,566,378 | A | 1/1986 | Fleissner |
| 5,152,214 | A | 10/1992 | Nordberg |
| 5,170,702 | A | 12/1992 | Schwelling |
| 5,379,687 | A | 1/1995 | Moseley |
| 5,546,855 | A | 8/1996 | Van Doorn et al. |
| 5,644,978 | A | 7/1997 | Jaenson et al. |
| 5,673,614 | A | 10/1997 | Jaenson et al. |
| 5,699,727 | A | 12/1997 | Schwelling |
| 5,816,140 | A | 10/1998 | Hart |

*Primary Examiner*—Stephen F. Gerrity
(74) *Attorney, Agent, or Firm*—Wood, Herron & Evans, L.L.P.

(57) ABSTRACT

A tying device and method of using same wherein the tying device has a wire guide member adapted to be mounted on an upper platen of a baling press. The wire guide member includes a top wall and side walls depending laterally from the top wall to form an elongated, longitudinally extending generally U-shaped channel within the wire guide member. The tying device further has a bottom wall intersecting one of the side walls to form a longitudinally extending wire discharge passage contiguous with the channel. A door is pivotally mounted proximate the one of the side walls at the forward end of the channel, and the door in a closed position has an unobstructed, flat inner surface substantially parallel to the top wall and extending across the discharge passage to form a portion of the bottom wall. The door has an inner, forward edge extending generally perpendicular to the side walls for guiding the wire tie into the channel. The tying device also has a first stop located on the top wall at the forward end of the channel opposite the forward edge of the door. The first stop has a forward directed wall depending from the top wall into the channel and is adapted to receive a looped end of the wire tie.

12 Claims, 5 Drawing Sheets

WIRE TIE GUIDE WITH TYING DEVICE AND METHOD

FIELD OF THE INVENTION

This invention relates generally to the field of baling presses and more particularly, to an improved wire tie guide and tying device for a baling press and a method of using the wire tie guide.

BACKGROUND OF THE INVENTION

Wire ties are generally considered to be an economical and sure means for securing a bale of material, for example, cotton, that is being compacted by a baling press. The baling press has opposed upper and lower platens between which the material to be baled is compressed. The wire tie has looped ends that, upon being placed in opposition and moved together, engage with each other to form a knot in a well known manner. The upper and lower platens further have a plurality of pairs of opposed channel bars that guide the wire tie around the bale. One of the tie bars includes a tying device to hold a first looped end while the second, opposite looped end is manually fed past, and interconnected with, the first looped end, thereby engaging the looped ends into a knot.

The above general structure has been known for decades, and many different manual and automatic devices have been devised to engage the looped ends of the wire tie into a knot. With manually operated baling presses, the operation of wrapping the plurality of heavy gage wire ties around a compressed bale and thereafter, engaging the looped ends into a knot, is a very tiring task. Further, it is sometimes possible to engage the short leg of the stationary looped end of the wire tie instead of the main, longer leg; and when that happens, either the loops interlock as two fish hooks or they do not engage at all. In either situation, the wire ties must be disengaged and re-engaged into a proper knot which is a time consuming and further tiring operation. Thus, there is a continuing effort to provide a more reliable and easy to operate tying device by further simplifying the manipulations required by the user.

SUMMARY OF THE INVENTION

The present invention provides an improved design of a bale wire tying device which very reliably facilitates engaging the looped ends of the wire tie into a proper knot. Further, the bale wire tying device of the present invention is modular in construction, thereby permitting the tying device components to be replaced independently of the wire guide itself. Further, the tying device of the present invention has the further advantages of providing a simple, durable, low cost structure that is easier to use, more economical to service and overall provides a more user friendly operation.

In accordance with the principles of the present invention and in accordance with the described embodiments, the present invention provides a tying device having a wire guide member adapted to be mounted on a platen of a baling press. The wire guide member includes a top wall and side walls depending laterally from the top wall to form an elongated, longitudinally extending generally U-shaped channel within the wire guide member. The tying device further has a bottom wall intersecting one of the side walls to form a longitudinally extending wire discharge passage contiguous with the channel. A door is pivotally mounted proximate the one of the side walls at the forward end of the channel, and the door in a closed position has an unobstructed, flat inner surface substantially parallel to the top wall and extending across the discharge passage to form a portion of the bottom wall. The door has an inner, forward edge extending generally perpendicular to the side walls for guiding the wire tie into the channel. The tying device also has a first stop located on the top wall at the forward end of the channel generally opposite the forward edge of the door, The first stop has a forward directed wall depending from the top wall into the channel and is adapted to receive a looped end of the wire tie.

In one aspect of the invention, a lateral projection is mounted forward of the stop and extends in a direction generally perpendicular to the top wall for limiting the opening at the forward end of the channel. In another aspect of the invention, a second stop is located on the top wall forward of the first stop. The second stop has a rearward directed wall depending from the top wall into the channel and forming a notch with the forward directed wall of the first stop to prevent the looped end of the wire tie on the first stop from moving toward the forward end of the channel.

In a second embodiment of the invention, the above described tying device is used in a method of engaging the looped ends of the wire tie together. With the method, a first looped end of a length of wire tie is advanced into a forward end of the one of the wire guide members, through the channel, through the curved chute, through an opposite wire guide member and out the forward end of the opposite wire guide member. Next, the first end of the wire tie is pulled to advance the second looped end of the wire tie into the forward end of the channel until the second looped end engages the first stop and is inhibited from further advancement. The first looped end is again inserted adjacent the lateral projection into the forward end of the one of the wire guide members and located against the inner, forward edge of the door. Thereafter, a generally longitudinal pushing force is applied along the wire tie while moving the wire tie over the inner, forward edge of the door, thereby pushing the second looped end with the first looped end against the top wall and simultaneously sliding the first looped end rearward with respect to the second looped end without contacting the flat, inner surface of the door. That pushing action causes the first looped end to be properly guided over, and engage with, the second looped end to form the knot. The first looped end is then pulled forward with respect to the second looped end to tighten the knot. As the upper and lower platens are thereafter moved away from each other to release the tied bale, the wire tie is released through the discharge passage and the knot pushes past the door.

These and other objects and advantages of the present invention will become more readily apparent during the following detailed description together with the drawings herein.

DETAILED DESCRIPTION OF THE INVENTION

Figure 1:
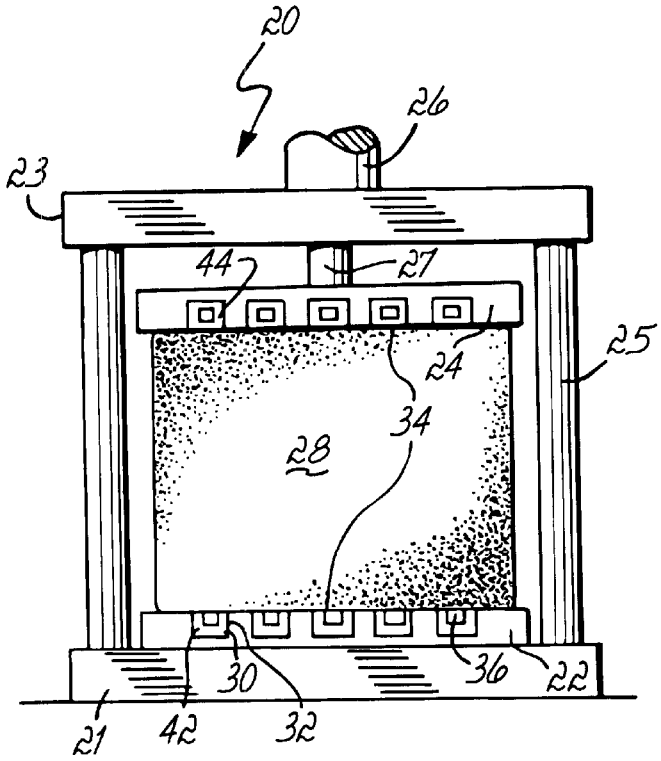
FIG. 1 is a schematic diagram of a front elevation view of a baling press with which the present invention is used.
Figure 2:
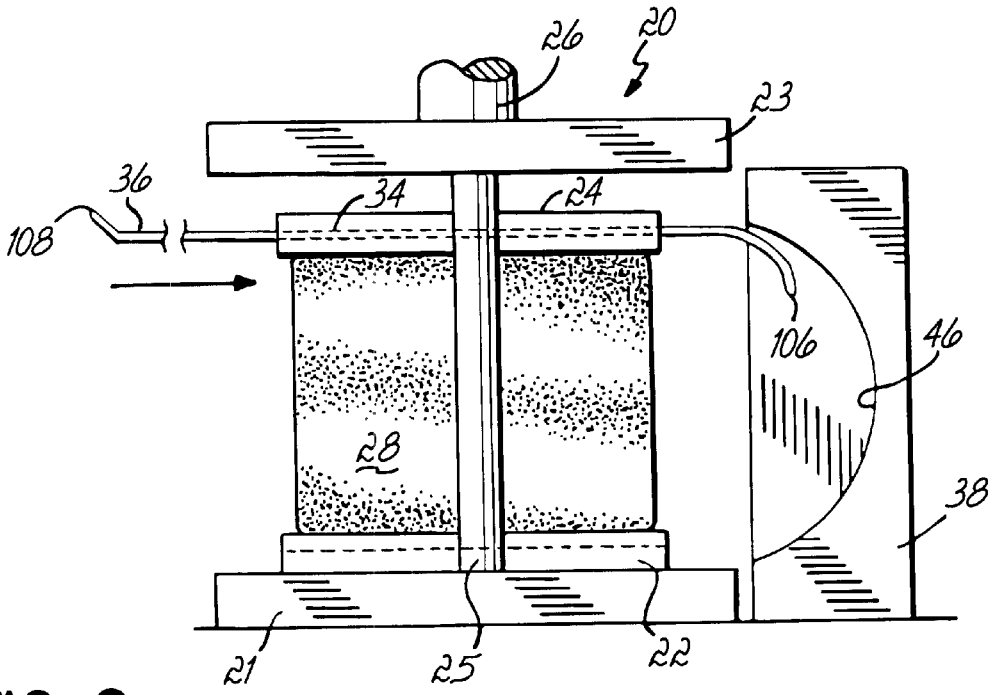
FIG. 2 is a schematic side elevation view of the baling press of FIG. 1.

Referring to FIG. 1, a baling press 20 is schematically illustrated as having a stationary lower frame member 21 supporting a stationary lower platen 22 and a stationary upper frame member 23. The lower and upper frame members 21, 23 are connected by two tie bars 25 to form a rigid frame structure. The upper frame member 24 supports a hydraulic cylinder 26 having a piston 27 connected to a movable upper platen 24. The hydraulic piston and cylinder unit 26 functions to move the upper platen 24 in a generally vertical direction with respect to the lower platen 22, and thus, the baling press 20 is suitable for compressing material, for example, cotton, into a bale 28. A plurality of opposing pairs of wire guide members 30 are mounted in slots 32 that extend between the front and rear of the press 20 in the lower and upper platens 22, 24. The wire guide members 30 provide wire guide channels 34 that facilitate guiding wire ties 36 around the bale 28. Referring to FIG. 2, the baling press 20 includes a chute 38 placed at the rear of the platens 22, 24. The chute 38 includes a curved wire path 40 that extends between the rear ends of the lower and upper platens 22, 24, respectively. The curved path 40 permits the wire tie 36 to be manually fed through the channel in the upper platen 24 across the rear of the baling press 20 by means of the curved path 40 and through the channel 34 in the lower platen 22 back to the front of the baling press 20.

Referring to FIG. 1, each pair of opposed wire tie guide members 30 includes a pass-through channel member 42 located in one of the platens, for example, the lower platen 22, and a wire tying guide member 44 located in the opposite platen, for example, the upper platen 24. The pass-through channel member 42 simply provides an unobstructed U-shaped channel 34 through which the wire tie 36 readily passes. The structure of each of the wire tying guide members 44 is illustrated in further detail in FIGS. 3–6. The wire tie guide member 44 has a generally U-shaped channel 48 extending between the front or forward end 50 and the rear end 52. The channel 48 is bounded by a top wall 54 and parallel side walls 56, 58 which depend laterally away from the top wall 54 in a generally perpendicular direction. A bottom wall section 60 extends from the lower edge of one of the side walls 58 in a perpendicular direction and generally parallel to the top wall 54. A wire tie discharge passage 62 is formed between the edge of the bottom wall section 60 and the opposite side wall 56.

Figures 3, 4, 5, 6:
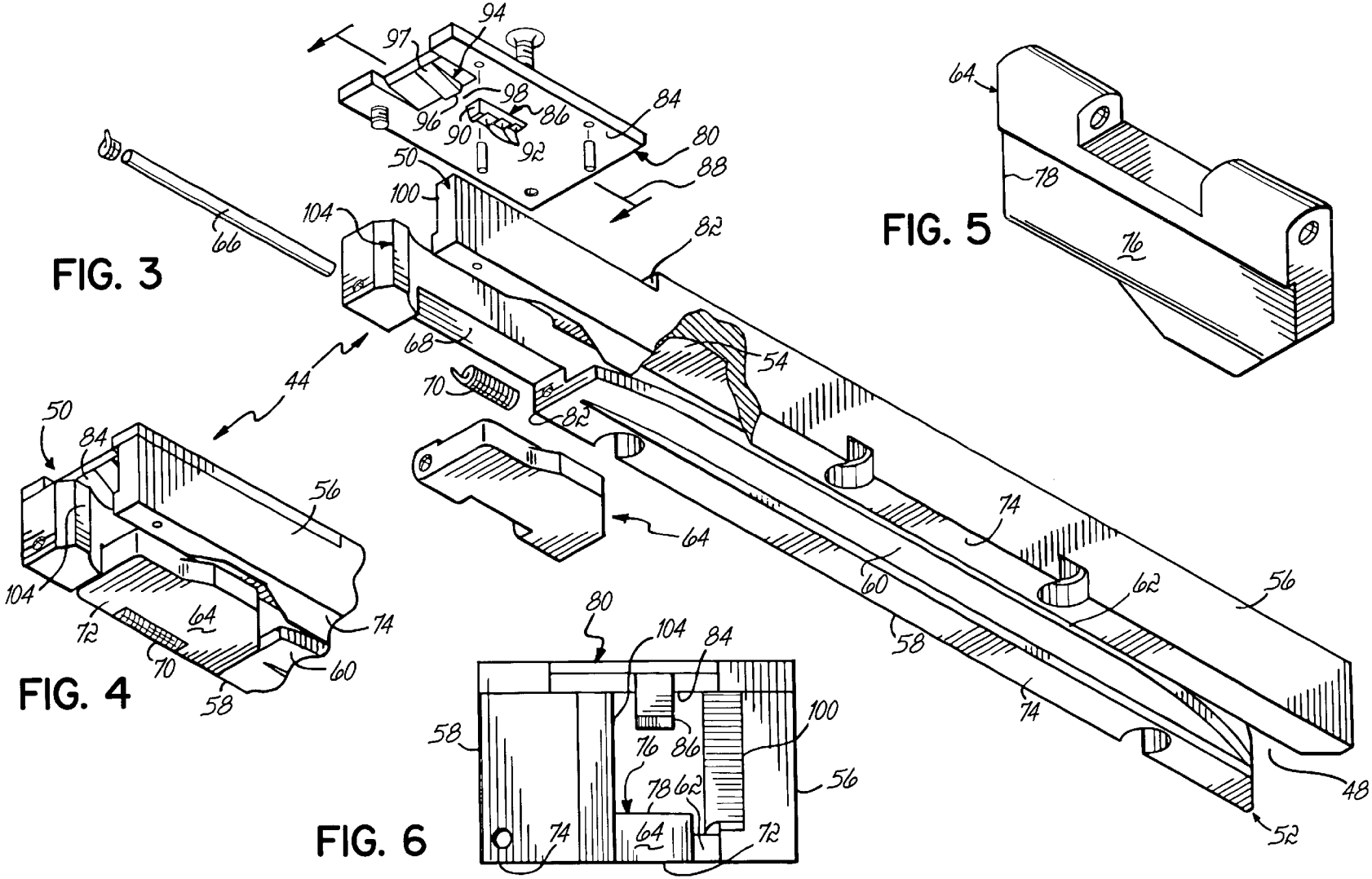
FIG. 3 is a disassembled perspective view of a bale wire tying device in accordance with the principles of the present invention.
FIG. 4 is a partial perspective view of the assembled tying device illustrated in FIG. 3.
FIG. 5 is a perspective view illustrating the inner side of the door used in the tying device of the present invention.
FIG. 6 is a forward end view of the tying device of the present invention illustrated in FIG. 4.

A door 64 is pivotally mounted on a shaft 66 within a cut-out or slot 68 in the one side wall 58. The door 64 is resiliently biased to a closed position by a spring 70. When in the closed position, the door 64 has an outer surface 72 that is generally co-planar with the bottom surfaces 74 of the side walls 56, 58. Further, when in the closed position, the door 64 extends across and blocks the wire discharge passage 62 at the front end 50 of the tying device 44. As shown in FIG. 5, the door 64 has an unobstructed flat inner surface 76 that terminates at an inner forward edge 78.

A removable plate 80 is mounted in a cut-out or notch 82 at the front end of the wire guide member 44 using locating pins 81 and fasteners 83. The plate 80 has an inner surface 84 that is generally co-planar with the top wall 54. The removable plate 80 has a first stop 86 that is mounted on the surface 84 close to a longitudinal center line 88. The first stop 86 includes a forward directed surface 90 and a rearward stepped surface formed by a plurality of surfaces 92 rearward of the surface 90 that step toward the surface 84. A second stop 94 is located forward of the first stop 86 and is also close to the longitudinal center line 88. The second stop 94 has a rearward directed surface 96 that depends generally perpendicularly from the top surface 84 and is generally aligned with the inner forward edge 78 of the door 64. The second stop 94 further has a flat, generally rectangular angled or sloped surface 97 that extends forward of the outer edge of the surface 96 and slopes toward the top surface 84. A notch 98 for receiving the second looped end of the wire tie 36 is formed between the forward directed surface 90 of the first stop 86 and the rearward directed surface 96 of the second stop 94.

The channel 48 at the front end 50 is widened by a surface 100 that is cut into or offset into the side wall 56. The wider channel formed by the surface 100 accommodates the two looped ends of the wire tie. The entrance at the front end 50 into the channel 48 is narrowed by a lateral projection 104. The lateral projection 104 has an edge or surface 105 opposite the surface 100 that extends between the top surface 84 and the side wall bottom surface 74.

Figure 7:
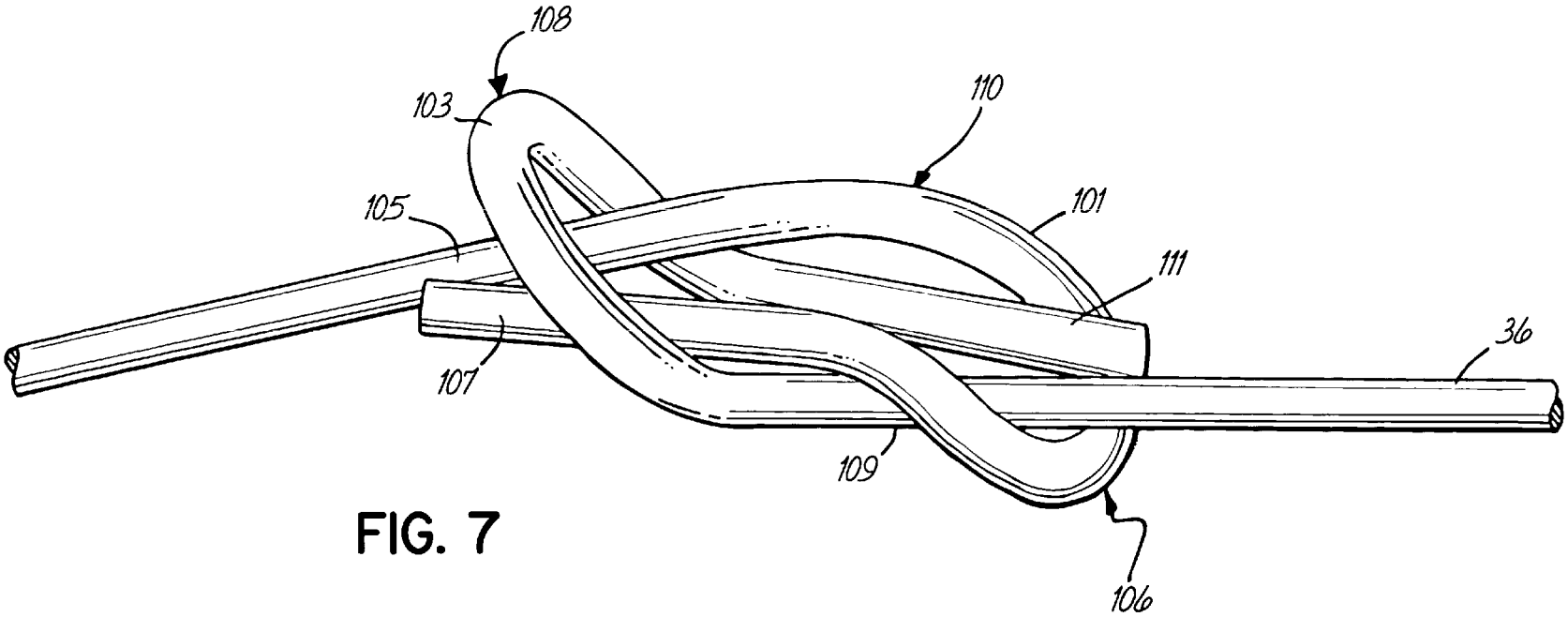
FIG. 7 is a perspective view of the looped ends of a piece of wire tie after they have been brought together and engaged in a knot.

Referring to FIG. 7, the wire tie 36 is preferably a wire tie commercially available as "CAR-LOK" waisted wire from International Fiber Packaging of Atlanta, Ga. The wire tie 36 has a natural bias tending to bend the wire tie 36 in a circular direction such that the looped ends 106, 108 are biased toward each other. The wire tie 36 has a first looped end 106 with a ski toe portion 101 angled downward and to the right, and the ski toe portion 101 has a main longer leg 105 and a shorter leg 107 forming the looped end 106. The opposite, second looped end 108 of the wire tie 36 has a ski toe portion 103 angled upward and to the right, and the ski toe portion 103 has a main, longer leg 109 and a shorter leg 111 forming a looped end 108 forming the looped end 108. As the looped ends 106, 108 are pushed together, they engage to form a knot 110 in a well known manner as will be shown and described.

In use, referring to FIG. 1, the baling press 20 is initially open and material to be compressed or compacted is loaded into the press. The baling press 20 is then operated to move the upper platen 24 toward the lower platen 22, thereby compacting the material into a bale 28. The bale must now be bound or tied so that it remains in the compressed state when the press is opened.

Referring to FIGS. 1–6, the first looped end 106 is first fed into the front end 50 of the wire guide member 44 in the upper platen 24, through the channel section 48, out the rear end of the wire guide member 44 into the curved path 40 of the chute 38 (FIG. 2). As the first looped end 106 moves around the curved path 40, it is aligned with the rear end of the channel 34 of the pass-through channel member 42 in the lower platen 22. The first looped end 106 passes through the channel 34 of the lower wire guide member 42 in the lower platen 22 and exits to the front 50 of the baling press 20.

Figure 8:
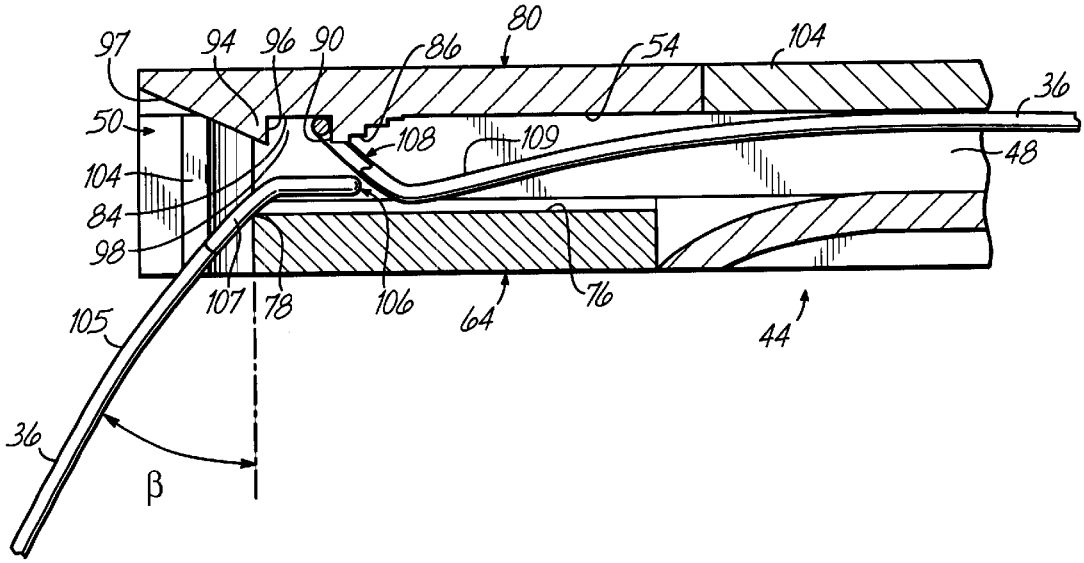
FIG. 8 is a cross-sectional view taken along line 8—8 of FIG. 4 and illustrates an initial location of the first looped end of the wire tie as it is inserted a second time in the wire guide in accordance with the principles of the present invention.

The operator then pulls on the first looped end 106, thereby feeding the second looped end 108 into the front end 50 of the upper wire guide member 44. The second looped end 108 contacts the angled or sloped forward surface 97 of the second stop 94. The second looped end 108 rides up the surface 97 and then drops into the notch 98 and over the first stop 86 as shown in FIG. 8. The forward directed surface 90 (FIG. 3) of the first stop 86 prevents the second looped end 108 from moving toward the rear of the upper wire guide member 44. However, the wire tie 36 is held in a relatively straight configuration throughout the length of the channel 48 in the upper wire guide member 44. The natural curved bias of the wire tie 36 has a tendency to hold the second looped end 108 upward.

Referring to FIG. 7, to reliably make a proper knot 110, it is important that the first looped end 106 guide over the longer, main leg 109 of the stationary looped end 108. If the looped end 106 guides over the shorter leg of the loop 108, the loops 106, 108 will either not join at all or, they will join as two fish hooks, that is, with only their short legs looped together. In either event, the process must be repeated until a proper knot 110 is formed. To facilitate the proper tying of a knot, the wire guide member 44 has a lateral projection 104 to properly direct the first looped end 106 with respect to the stationary looped end 108. The lateral projection 104 provides a limited opening through which the first looped end 106 can be inserted. The shorter leg 111 (FIG. 7) of the stationary second looped end 108 is partially behind the lateral projection 104, and thus, the lateral projection 104 serves to orient the first looped end 106 with respect to the main, longer leg of the second looped end 108, so that the looped end 106 is guided over the longer leg of the looped end 108 to reliably and properly engage to form the knot 110.

The first looped end 106 is again inserted in the front end 50 of the wire guide member 44. As shown in FIG. 8, the first looped end 106 is first located against the inner forward edge 78 of the door 64 so that the wire tie 36 is at a relatively small angle β with respect to a vertical direction, for example, approximately 30°. Consequently, the wire can be inserted using the natural curve of the wire, and little or no bending of the wire tie is required to insert and locate the wire tie 36 on the forward edge 78 of the door 64. Thereafter, using the front edge 78 of the door 64 as a fulcrum or guide edge, a generally longitudinal pushing force is applied to the wire tie 36 adjacent the first looped end 106 while moving the wire tie over the inner forward edge 78 of the door 64. With that motion, the first looped end 106 moves into contact with the second looped end 108 and pushes the second looped end 108 up against the top surface 84 of the notch 98. With a continued pushing force, the first looped end 106 is guided over the main, longer leg of the stationary second looped end 108. In this process, the user may also guide the looped end 106 against the inner surface 100 of the side wall 56, thereby using the surface 100 as a lateral guide.

Figure 9:
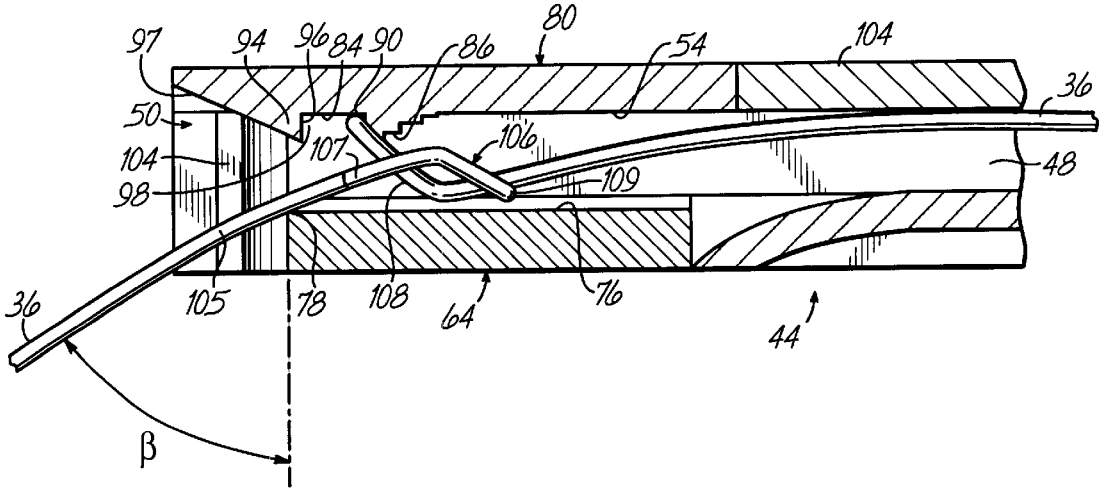
FIG. 9 is a cross-sectional view taken along line 8—8 of FIG. 4 and illustrates a second location of the first looped end with the second looped end in which the first looped end pushes the second looped end against the top wall in accordance with the principles of the present invention.
Figure 10:
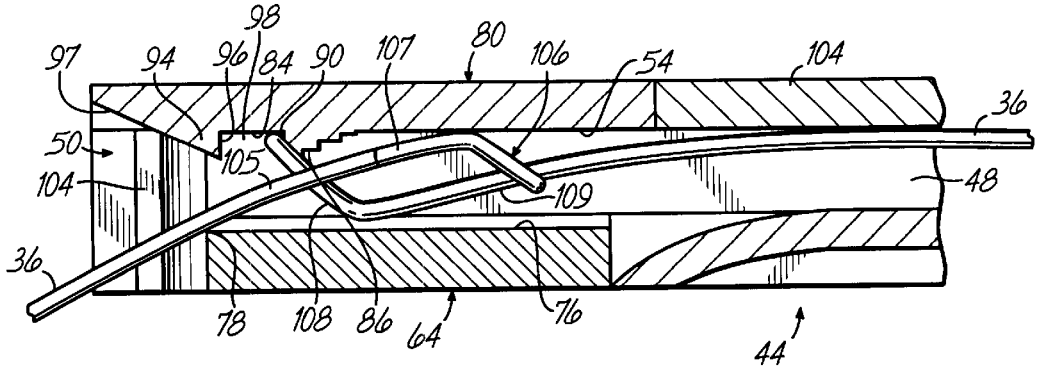
FIG. 10 is a cross-sectional view taken along line 8—8 of FIG. 4 and illustrates a third location of the first looped end with the second looped end in which the first looped end engages with the second looped end to form the knot in accordance with the principles of the present invention.
Figure 11:
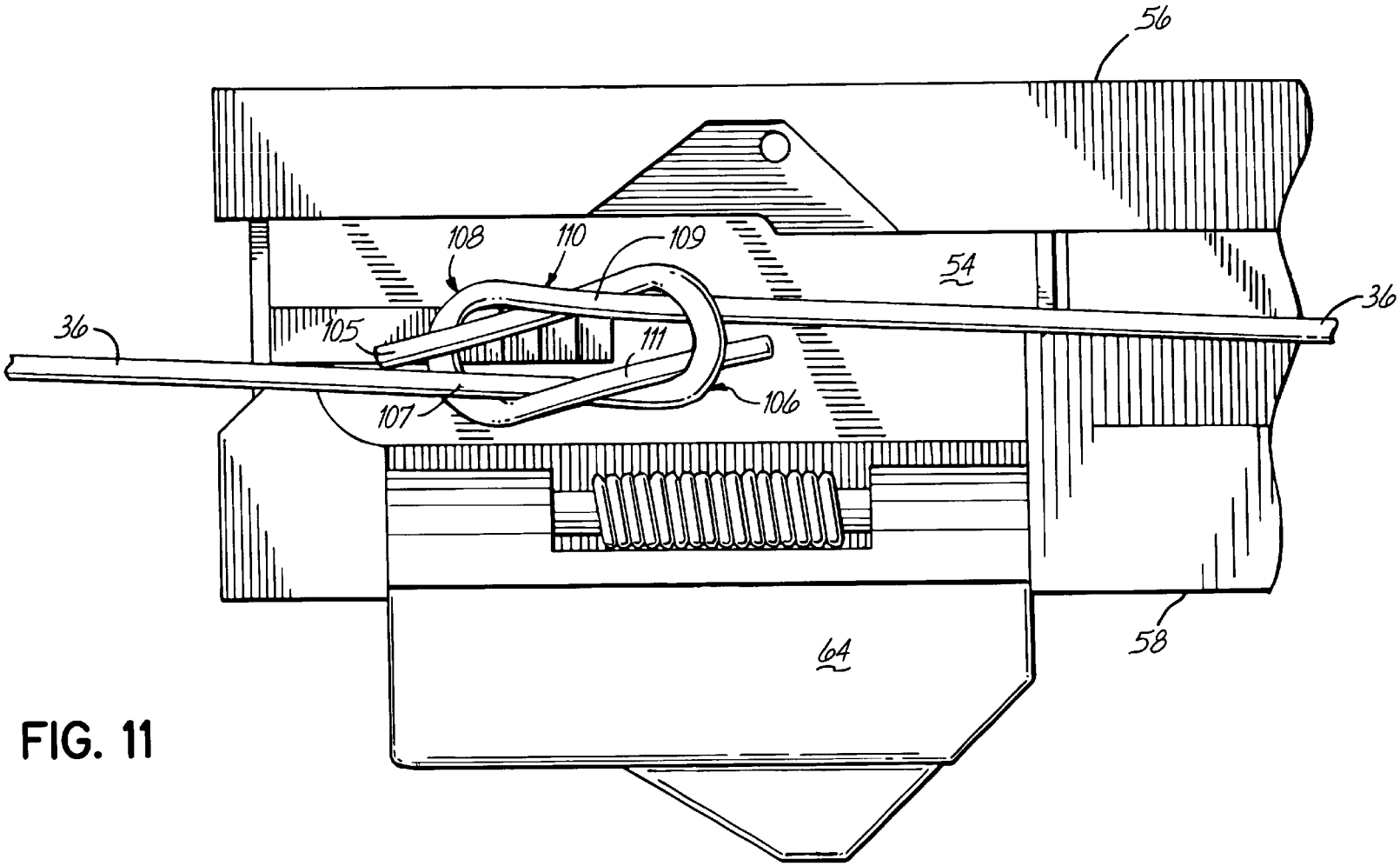
FIG. 11 is a lower planar view illustrating the wire guide member with the door open and the knot of looped ends tightened against the second stop in accordance with the principles of the present invention.

As shown in FIG. 9, while using the edge 78 as a fulcrum and guide, the longitudinal pushing force on the wire tie 36 moves the looped end 106 upward and rearward, and the wire tie 36 naturally bends as it is guided over the main, longer leg of the stationary looped end 108 to an angle β of approximately 45° with the vertical direction. Thus, the bending of the wire tie 36 is a result of structure of the wire tying guide member 44 and the longitudinal pushing of the user. The user is not required to bend the wire tie in the knot-tying process. Continued application of the longitudinal pushing force on the wire tie 36 results in the first looped end 106 continuing to be guided by the main, longer leg of the stationary loop 108 as it moves rearward in the channel 48 as shown in FIG. 10. During this motion, the first looped end 106 properly engages with the stationary second looped end 108 to form the knot 110. During the travel of the first looped end 106 through the channel 48, it is maintained above and out of contact with the unobstructed inner surface 76 of the door 64. Thereafter, the wire tie 36 at the first looped end 106 is pulled to move the first looped end 106 forward in the channel 48. That action also moves the second looped end 108 in the forward direction until it contacts the rearward directed surface 96 of the second stop 94 as shown in FIG. 11. Thus, continued pulling on the wire tie 36 causes the knot 110 formed by the looped ends 106, 108 to tighten.

After all of the wire ties have been knotted around the bale, the operator operates the hydraulic system 26 (FIG. 1) of the baling press 20 to move the upper platen 24 away from the lower platen 22. As the upper platen moves away from the bale 28, the wire tie 36 is released from the upper tying device 44 through the wire tie discharge passage 62. In addition, the knot formed by the looped ends 106, 108 pushes the door 64 downward. The door pivots open, thereby releasing the knotted looped ends 106, 108, and thereafter, the spring 70 biases the door 64 back to its closed position.

The tying device of the present invention permits opposed looped ends 106, 108 of the wire tie 36 to be knotted with minimal operator effort. As has been illustrated, the insertion of the first looped end 106 into the wire guide member 44 is accomplished with very little, if any, bending of the wire tie 36 adjacent the first looped end 106. Further, after repeated uses, it is possible for one of the stops 86, 94 to wear or break. In that event, it is a relatively simple process to remove the tying device 44 from the platen 24 and remove the removable plate 80 with the defective stop. A new plate is then easily installed and the wire guide member 44 returned to active service in a short time and at minimal cost. Thus, the wire guide member of the present invention provides a simple, durable, low cost structure that provides a very user friendly operation.

While the invention has been set forth by a description of the preferred embodiment in considerable detail, it is not intended to restrict or in any way limit the claims to such detail. Additional advantages and modifications will readily appear to those who are skilled in the art. For example, while the baling press is described as having an upper platen 24 moving with respect to a lower platen 22, other baling presses have an opposite configuration in which a lower platen moves with respect to an upper platen. In those applications, the wire tying guide member 44 would be mounted in the lower platen, and the other pass-through wire guide member 42 would be mounted in the upper platen. In other applications, a horizontal press may be used in which a movable platen moves in a horizontal direction towards and away from a stationary platen. In those applications, the wire tying guide member 44 may be mounted in either the movable or stationary platen and on either the right hand side or the left hand side of the press.

In the described embodiment, the stops 86, 94 are described as being mounted on a removable plate 80. As will be appreciated, if the plate 80 is not utilized, the stops 86, 94 are mounted on the top wall 54 extending to the front end 50 of the wire guide member 44. As will be appreciated, the wire guide member 44 may be machined from a solid, or fabricated by joining separate component parts in a known manner.

Therefore, the invention in its broadest aspects is not limited to the specific detail shown and described. Consequently, departures may be made from the details described herein without departing from the spirit and scope of the claims which follow.

What is claimed is:

1. A baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising:

a wire guide member adapted to be mounted on the upper platen of the baling press, the wire guide member including a top wall, side walls depending laterally from the top wall to form an elongated, longitudinally extending generally U-shaped channel within the wire guide member, the channel having forward and rearward ends, and a bottom wall intersecting one of the side walls to form a longitudinally extending wire discharge passage contiguous with the channel;

a door pivotally mounted proximate the one of the side walls at the forward end of the channel, the door in a closed position having an unobstructed, flat inner surface substantially parallel to the top wall and extending across the discharge passage to form a portion of the bottom wall, and the door having an inner, forward edge extending generally perpendicular to the side walls for guiding the wire tie into the channel; and a first stop located on the top wall at the forward end of the channel opposite the forward edge of the door, the first stop having a forward directed wall depending from the top wall into the channel and adapted to receive a looped end of the wire tie.

2. A baling wire tying device of claim 1 further comprising a lateral projection mounted forward of the stop and partially obstructing the channel in a direction generally perpendicular to the top wall for limiting an opening to the channel.

3. A baling wire tying device of claim 1 wherein the first stop has a plurality of surfaces extending serially rearward from the forward directed surface to form a series of steps that intersect the top wall of the channel.

4. A baling wire tying device of claim 1 further comprising a second stop located on the top wall forward of the first stop, the second stop having a rearward directed wall depending from the top wall into the channel and forming a notch with the forward directed wall of the first stop to prevent the looped end of the wire tie on the first stop from moving toward the forward end of the channel.

5. A baling wire tying device of claim 4 wherein the second stop has an angled surface extending forward from the rearward directed surface and intersecting the top wall, the angled surface directing the looped end of the wire tie into the notch and over the first stop.

6. A baling wire tying device of claim 4 wherein the first and the second stops are mounted on a removable plate attachable to the wire guide member and forming part of the top wall at the forward end of the channel.

7. A baling wire tying device of claim 1 wherein the first stop is mounted on a removable plate attachable to the wire guide member and forming part of the top wall at the forward end of the channel.

8. A baling wire tying device of claim 7 wherein the removable plate is attachable to the side walls of the channel.

9. A baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising:

a wire guide member adapted to be mounted on the upper platen of the baling press, the wire guide member including a top wall, side walls depending laterally from the top wall to form an elongated, longitudinally extending generally U-shaped channel within the wire guide member, the channel having forward and rearward ends, and a bottom wall intersecting one of the side walls to form a longitudinally extending wire discharge passage contiguous with the channel;

a door pivotally mounted proximate the one of the side walls at the forward end of the channel, the door in a closed position having an unobstructed, flat inner surface substantially parallel to the top wall and extending across the discharge passage to form a portion of the bottom wall, and the door having an inner, forward edge extending generally perpendicular to the side walls for guiding the wire tie into the channel;

a removable plate attachable to the wire guide member and forming part of the top wall at the forward end of the channel, the plate including a first stop located on the top wall at the forward end of the channel opposite the forward edge of the door, the first stop having a forward directed wall depending from the top wall into the channel and adapted to receive a looped end of the wire tie, and a second stop located on the top wall forward of the first stop, the second stop having a rearward directed wall depending from the top wall into the channel and forming a notch with the forward directed wall of the first stop to prevent the looped end of the wire tie on the first stop from moving toward the forward end of the channel; and a lateral projection mounted forward of the second stop and partially obstructing the channel in a direction generally perpendicular to the top wall.

10. A method of engaging pre-formed looped ends of a wire tie in a baling press after opposed upper and lower platens of the baling press have compressed a material to be baled between the platens, the upper and lower platens having respective wire guide members mounted therein and extending between front and rear sides of the press, the baling press having a curved chute positioned at the rear of the platens adjacent the wire guide members and providing an unobstructed path between the wire guide members at the rear of the press, the wire guide members and the chute facilitate guiding a wire tie around a bale of material being compressed between the platens of the baling press, wherein the wire tie has pre-formed looped ends being engageable with each other to form a knot by moving one looped end relative to an opposite looped end, one of the wire guide members including an inverted, generally U-shaped channel having a top wall located with a respective platen and a longitudinally extending wire discharge passage opening toward an opposite lower platen, a door pivotally mounted at a forward end of the channel, the door, in a closed position, having an unobstructed, flat inner surface substantially parallel to the top wall and extending across the wire discharge passage, and the door having an inner, forward edge extending across the wire discharge passage, a lateral projection mounted forward of the stop and partially obstructing the channel in a direction generally perpendicular to the top wall, and a first stop located on the top wall at the forward end of the channel opposite the forward edge of the door, the first stop having a forward directed wall depending from the top wall into the channel and adapted to receive a looped end of the wire tie, the method comprising:

advancing a first looped end of a wire tie into a forward end of the one of the wire guide members, through the channel, through the curved chute, through an opposite wire guide member and out the forward end of the opposite wire guide member;

pulling the first end of the wire tie to advance the second looped end of the wire tie into the forward end of the channel until the second looped end engages the first stop and is inhibited from further advancement;

inserting the first looped end into the forward end of the one of the wire guide members;

locating the first looped end against the inner, forward edge of the door, applying a generally longitudinal pushing force along the wire tie while guiding the wire tie on the inner, forward edge of the door to push the second looped end with the first looped end against the top wall and slide the first looped end rearward with respect to the second looped end without contacting the flat, inner surface of the door, thereby causing first looped end to engage with the second looped end to form the knot; and pulling on the wire tie to move the first looped end forward with respect to the second looped end to tighten the knot, the upper and lower platens being thereafter moved away from each other and the wire tie being released through the discharge passage and the knot being released by pushing the door open as the platens are moved.

11. A method of engaging pre-formed looped ends of a wire tie in a baling press after opposed upper and lower platens of the baling press have compressed a material to be baled between the platens, the upper and lower platens having respective upper and lower wire guide members mounted therein and extending between front and rear sides of the press, the baling press having a curved chute positioned at the rear of the platens adjacent the upper and lower wire guide members and providing an unobstructed wire path between the upper and lower wire guide members at the rear of the press, the upper and lower wire guide members and the chute facilitate guiding a wire tie around a bale of material being compressed between the platens of the baling press, wherein the wire tie has pre-formed looped ends being engageable with each other to form a knot by moving one looped end relative to an opposite looped end, the upper wire guide member including an inverted, generally U-shaped upper channel having a top wall located with the upper platen and a longitudinally extending wire discharge passage opening downward toward the lower platen, a door pivotally mounted at a forward end of the upper channel, the door, in a closed position, having an unobstructed, flat inner surface substantially parallel to the top wall and extending across the wire discharge passage, and the door having an inner, forward edge extending across the wire discharge passage, a lateral projection mounted forward of the stop and partially obstructing the channel in a direction generally perpendicular to the top wall, and a first stop located on the top wall at the forward end of the upper channel opposite the forward edge of the door, the first stop having a forward directed wall depending from the top wall into the upper channel and adapted to receive a looped end of the wire tie, the method comprising:

advancing a first looped end of a wire tie into a forward end of the upper wire guide member, through the upper channel, through the curved chute, through the lower wire guide member and out the forward end of the lower wire guide member;

pulling the first end of the wire tie to advance the second looped end of the wire tie into the forward end of the upper channel until the second looped end engages the first stop and is inhibited from further advancement;

inserting the first looped end into the forward end of the upper wire guide member;

locating the first looped end against the inner, forward edge of the door, applying a generally longitudinal pushing force along the wire tie while guiding the wire tie on the inner, forward edge of the door to push the second looped end with the first looped end against the top wall and slide the first looped end rearward with respect to the second looped end without contacting the flat, inner surface of the door, thereby causing the first looped end to engage with the second looped end to form the knot; and pulling on the wire tie to move the first looped end forward with respect to the second looped end to tighten the knot, the upper and lower platens being thereafter moved away from each other and the wire tie being released through the discharge passage and the knot being released by pushing the door open as the platens are moved.

12. A method of engaging pre-formed looped ends of a wire tie of claim 11 wherein the baling press further includes a second stop located on the top wall forward of the first stop and the method further comprises blocking motion of the second looped end with the second stop in response to pulling on the wire tie to move the first looped end forward with respect to the second looped end.

* * * * *